US011355334B2

(12) United States Patent
Baba

(10) Patent No.: US 11,355,334 B2
(45) Date of Patent: Jun. 7, 2022

(54) METHODS AND SYSTEMS FOR ANALYZING PROTEINS VIA ELECTRON CAPTURE DISSOCIATION

(71) Applicant: DH Technologies Development Pte. Ltd., Singapore (SG)

(72) Inventor: Takashi Baba, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 50 days.

(21) Appl. No.: 16/312,009

(22) PCT Filed: Jun. 20, 2017

(86) PCT No.: PCT/IB2017/053665
§ 371 (c)(1),
(2) Date: Dec. 20, 2018

(87) PCT Pub. No.: WO2017/221151
PCT Pub. Date: Dec. 28, 2017

(65) Prior Publication Data

US 2019/0378703 A1 Dec. 12, 2019

Related U.S. Application Data

(60) Provisional application No. 62/352,836, filed on Jun. 21, 2016.

(51) Int. Cl.
*H01J 49/06* (2006.01)
*H01J 49/00* (2006.01)

(52) U.S. Cl.
CPC ..... *H01J 49/063* (2013.01); *H01J 49/0054* (2013.01)

(58) Field of Classification Search
None
See application file for complete search history.

(56) References Cited

U.S. PATENT DOCUMENTS

2004/0245448 A1 12/2004 Glish
2006/0186331 A1* 8/2006 Hartmer ..... H01J 49/0072 250/288

(Continued)

FOREIGN PATENT DOCUMENTS

WO WO-2013098600 A1 * 7/2013 ..... H01J 49/4225
WO WO-2014191821 A1 * 12/2014 ..... H01J 49/0072
WO 2015-189749 12/2015

OTHER PUBLICATIONS

Written Opinion of the International Searching Authority for PCT/IB2017/053665, dated Oct. 12, 2017.

*Primary Examiner* — James Choi

(57) ABSTRACT

Methods and systems are provided herein for selectively removing product ions resulting from an ECD dissociation event from the interaction region of an ECD reaction cell, while other precursor peptide ions continue to undergo ECD within the interaction region, thereby reducing or preventing the occurrence of multiple electron capture events by the product ions. In some aspects, the preferential extraction of product ions from the interaction region during the ECD reaction can occur without an auxiliary AC field being generated within the interaction region. Additionally, in some aspects, the methods and systems disclosed herein can subject the various product ions to a non-dissociative charge reduction via exposure to reagent ions of the opposite polarity so as to selectively concentrate product ions to a lower charge state.

19 Claims, 5 Drawing Sheets

(56) References Cited

U.S. PATENT DOCUMENTS

| | | | | |
|---|---|---|---|---|
| 2011/0062323 | A1* | 3/2011 | Brown | H01J 49/28<br>250/282 |
| 2015/0097114 | A1* | 4/2015 | Green | H01J 49/10<br>250/282 |
| 2015/0255264 | A1* | 9/2015 | Baba | H01J 49/427<br>250/283 |
| 2016/0126076 | A1* | 5/2016 | Baba | H01J 49/063<br>250/489 |

* cited by examiner

METHODS AND SYSTEMS FOR ANALYZING PROTEINS VIA ELECTRON CAPTURE DISSOCIATION

RELATED APPLICATIONS

This application claims the benefit of priority from U.S. Provisional Application Ser. No. 62/352,836, filed on Jun. 21, 2016, the entire contents of which is hereby incorporated by reference.

FIELD

The teachings herein relate to mass spectrometry, and more particularly, to methods and systems for analyzing proteins via electron capture dissociation.

BACKGROUND

Mass spectrometry (MS) is an analytical technique for determining the elemental composition of test substances that has both quantitative and qualitative applications. For example, MS can be used to identify unknown compounds and/or determine the structure of a particular compound by observing its fragmentation. Recently, MS has played an increasingly important role in proteomics due to the speed, specificity, and sensitivity of MS strategies in characterizing and identifying peptides and proteins.

One strategy in characterizing proteins using MS-based proteomics is a "bottom-up" approach in which protein(s) of interest are subject to enzymatic digestion (e.g., via trypsin, LysC, etc.) and one or more separations (e.g., multi-dimensional LC) prior to subjecting the peptide fragments to MS analysis (MS') or tandem MS/MS analysis ($MS^2$). In a "bottom up" $MS^2$ workflow, collision induced dissociation (CID) is typically utilized to dissociate the precursor peptide fragments selected in the first MS stage into product ion fragments. The amino acid sequence of the precursor peptide ion can then be deduced from the masses of the product ion fragments. In CID, energetic collisions between the ionized precursors ions and inert neutral gas and/or nitrogen molecules vibrate and eventually dissociate (cleave) backbone amide bonds, thereby yielding b-type (N-terminal) and y-type (C-terminal) product ions. By identifying several of the product ion peptides, the original protein can be determined (e.g., by referencing known sequences in a protein or genome database). However, because CID reactions generally occur only at the weakest peptide amide bonds, incomplete fragmentation along the peptide backbone can make complete reconstruction of the peptide sequence difficult. Another key limitation to the use of CID in proteomics is the loss of post-translational modifications (PTMs) during the dissociation. PTMs (e.g., phosphorylated or sulfated functional groups), which are often only weakly bound to the peptide backbone, can be stripped from the peptide during fragmentation, thereby preventing the detection and characterization of PTMs in the $MS^2$ spectra.

As opposed to the "bottom up" approach, an alternative MS-based proteomics strategy utilizes a "top down" analysis in which intact proteins are subjected to dissociation in a mass spectrometer. While conventional CID generally dissociates too few sites to provide complete information to characterize the intact proteins' entire amino acid sequence, electron capture dissociation (ECD) and electron transfer dissociation (ETD) have been identified as possible alternatives to CID for "top-down" sequencing of intact proteins due to their more complete fragmentation of the peptide backbone. ECD, for example, utilizes ionic interactions between a precursor ion and low-energy electrons that lead to capture of the electrons by the multiply-charged precursor, which quickly induces a more extensive cleavage of the N-aC bonds to primarily yield c-type (N-terminal end) and z-type (C-terminal end) product ions (e.g., of different peptide lengths). ETD, on the other hand, reacts the multiply-charged precursor ions with reagent ions of opposite charge to transfer electrons to the precursor ions, thereby leading to dissociation. Because the dissociation energy is typically not distributed (or less distributed) throughout the precursor peptide in ECD and ETD, weakly-bound PTMs are more likely to remain attached to the peptide for subsequent detection in a downstream MS analysis. In some aspects, ECD may be preferable over ETD based on the increased effectiveness of the high energy electrons in efficiently dissociating peptide ions.

One obstacle to a "top down" ECD approach, however, is the complexity of the $MS^2$ spectra resulting from the occurrence of multiple ECD reactions. Though promoting multiple ECD events may decrease the variation in the charge states of fragments containing a particular sequence, this strategy can also present obstacles in correctly characterizing the entire peptide sequence due to the increased presence of internal peptide fragments following the multiple dissociation events (i.e., some of the resulting product ions of peptide fragments lack both an N-terminus and C-terminus). That is, as the length of the c-type and z-type fragments becomes shorter and shorter with each subsequent dissociation of a product ion, mass spectrometric data cannot effectively reveal sequence information for the peptide's middle portion and can therefore make complete reconstruction of the peptide sequence difficult.

Accordingly, there remains a need for improved methods and systems for ECD-based analysis of proteins.

SUMMARY

In accordance with various aspects of the present teachings, methods and systems are disclosed herein for selectively removing product ions resulting from an ECD event from the interaction region of an ECD reaction cell, while other precursor protein ions continue to undergo ECD within the interaction region. Because a small amplitude auxiliary AC field can alter the kinetic energy of the electrons with which the precursor ions react to the detriment of the ECD reaction efficiency, exemplary methods and systems described herein can provide for the preferential extraction of product ions from the interaction region during the ECD reaction and without such an auxiliary AC field being generated within the interaction region (i.e., non-resonant extraction). In this manner, various aspects of the present teachings can reduce or prevent the occurrence of subsequent electron capture events by the product ions (e.g., secondary or tertiary ECD events) so as to limit precursor ions to a single dissociation event. As a result, the ECD reaction of the plurality of precursor ions can predominantly generate c-type and z-type product ions (e.g., exhibiting different peptide lengths depending on the location of the cleaved bond). Thereafter, the methods and systems disclosed herein can subject the various product ions to a proton transfer reaction (PTR), which provides a non-dissociative charge reduction via exposure to reagent ions of the opposite polarity. Thus, in certain aspects, the teachings herein can provide an improved strategy for generating a complete sequence for peptide ions utilizing the high dissociation efficiency of ECD, while nonetheless resulting in a less-convoluted mass spectrum, for example, relative to that which would result following multiple ECD.

In accordance with various aspects of the present teachings, a method of analyzing ions is provided, the method comprising receiving precursor ions (e.g., precursor protein ions) generated by an ion source through a proximal inlet end of an ion processing device, and introducing electrons into an interaction region of the ion processing device such that the electrons interact with precursor ions within said interaction region to form product ions via electron capture dissociation, wherein said product ions are preferentially removed (e.g., mass selectively removed) from the interaction region upon formation and as precursor ions continue to interact with the electrons. The method can further comprise receiving reagent ions generated by a charged species source through the proximal inlet end of the ion processing device and interacting the product ions with the reagent ions so as to concentrate the product ions at a lower charge state.

Ion processing devices in accordance with the present teachings can have a variety of configurations and can be operated in a variety of manners. In some aspects, for example, the ion processing device can comprise a first set of electrodes at least a first segment of which is arranged in a quadrupole orientation about a first central axis, wherein said first segment of the first set of electrodes extends axially along the first central axis from the proximal inlet end to a distal end so as to define a first portion of a first pathway extending along the first central axis; and a second set of electrodes at least a first segment of which is arranged in a quadrupole orientation about the first central axis so as to define a second portion of the first pathway, wherein the first segment of the second set of electrodes extends axially along said first central axis from a proximal end to a distal outlet end, the proximal end of the second set of electrodes being spaced apart from the distal end of the first set of electrodes such that a transverse pathway extends between the proximal end of the second set of electrodes and the distal end of the first set of electrodes, said transverse pathway extending from a first axial end to a second axial end along a second central axis substantially orthogonal to the first central axis and intersecting with the first pathway at an intersection region, wherein said transverse pathway defines said interaction region. Further in related aspects, said step of receiving precursor ions in the ion processing device can comprise trapping the precursor ions within said second portion of the first pathway, and said step of introducing electrons into the interaction region of said ion processing device can comprise transmitting the electrons along the transverse pathway toward the intersection region. In various aspects, an auxiliary AC signal can be applied to the second set of electrodes so as to selectively drive precursor ions trapped within the second portion of the first pathway into the interaction region as electrons are being introduced therein, wherein the product ions are removed to and trapped within the second portion of the first pathway upon formation of the product ions. Additionally or alternatively, certain aspects of the method can further comprise trapping the reagent ions in the first portion of the first pathway while interacting the precursor ions with the electrons in the interaction region of the ion processing device.

In various aspects of applicant's present teachings, the method can further comprise transmitting through a distal outlet end of the ion processing device into a downstream quadrupole rod set the product ions removed from the interaction region upon formation; and trapping said product ions in the downstream quadrupole rod set as precursor ions within the interaction region interact with the electrons and prior to interacting the product ions with reagent ions to concentrate the product ions at the lower charge state, wherein the reagent ions can be transmitted through the ion processing device and into the downstream quadrupole rod set while said product ions are trapped therein so as to selectively reduce the charge of the product ions to concentrate the product ions at the lower charge state.

In some alternative aspects of applicant's present teachings, the method can further comprise transmitting through a distal outlet end of the ion processing device into a downstream quadrupole rod set the product ions removed from the interaction region upon formation and trapping said product ions in the downstream quadrupole rod set as precursor ions within the interaction region interact with the electrons and prior to interacting the product ions with reagent ions to concentrate the product ions at the lower charge state. In some aspects, the electron capture dissociation can then be terminated within the ion processing device and the product ions trapped within the downstream quadrupole rod set can then be transmitted back into the ion processing device for interaction with said reagent ions.

In various aspects, the electrons can interact with the precursor ions in the absence of an auxiliary AC excitation field in the interaction region, and thereafter, the product ions can interact with the reagent ions in the presence of an auxiliary gate AC field.

In accordance with various aspects of the present teachings, a system for analyzing ions is provided, the system comprising a sample ion source, a charged species source, an electron source, and an ion processing device. The ion processing device can receive precursor ions (e.g., precursor peptide ions) generated by the ion source through a proximal inlet end and electrons from the electron source into an interaction region of the ion processing device such that the electrons interact with precursor ions within the interaction region to form product ions via electron capture dissociation, wherein said product ions are preferentially removed (e.g., mass selectively removed) from the interaction region upon formation and as precursor ions continue to interact with the electrons. Reagent ions generated by the charged species source can trapped within the ion processing device for interacting with the product ions removed from the interaction region or can be transmitted through the ion processing device into a downstream mass analyzer for interacting with the product ions so as to concentrate the product ions at a lower charge state.

In some aspects of the present teachings, a system for analyzing ions is provided, the system comprising a first set of electrodes at least a first segment of which is arranged in a quadrupole orientation about a first central axis, wherein said first segment of the first set of electrodes extends axially along said first central axis from a proximal inlet end to a distal end so as to define a first portion of a first pathway extending along said first central axis, said proximal inlet end for receiving precursor ions from an ion source and reagent ions of the opposite polarity from the precursor ions from a charged species source; and, a second set of electrodes at least a first segment of which is arranged in a quadrupole orientation about the first central axis so as to define a second portion of the first pathway, wherein said first segment of the second set of electrodes extends axially along said first central axis from a proximal end to a distal outlet end, the proximal end of the second set of electrodes being spaced apart from the distal end of the first set of electrodes such that a transverse pathway extends between the proximal end of the second set of electrodes and the distal end of the first set of electrodes, said transverse pathway extending from a first axial end to a second axial end along a second central axis substantially orthogonal to the first central axis and intersecting with the first pathway at an intersection region. The system can also include an electron source disposed proximate to one of the first and second axial ends of the second pathway for introducing a plurality of electrons along the second central axis such that said electrons travel through said transverse pathway toward said intersection region. Further, the system can comprise one or more power sources for providing DC and RF voltages to said first and second sets of electrodes and to generate an RF electric field in each of the first and transverse pathways, and a controller for controlling the DC and RF voltages applied to each of the first and second set of electrodes, said controller configured to: i) generate an RF quadrupole field in the transverse pathway while the electron source introduces a plurality of electrons therealong such that at least a portion of the precursor ions in the transverse pathway interact with the electrons to dissociate to form product ions via electron capture dissociation, ii) generate an extraction electric field in at least the second portion of the first pathway such that product ions are removed from the transverse pathway upon formation and as precursor ions interact with the electrons, and iii) generate an electric field in the first and second portions of the first pathway such that reagent ions received at the inlet end of the first pathway are transmitted along the first pathway, said reagent ions for reducing the charge of the product ions to concentrate the product ions at lower charge state(s). In some aspects, an auxiliary AC field is not generated within the transverse pathway while the electron source introduces a plurality of electrons therealong.

In various related aspects, the system can also comprise a third set of electrodes arranged in a quadrupole orientation about the second central axis and extending between the first axial end of the transverse pathway and the intersection region; and a fourth set of electrodes arranged in a quadrupole orientation about the second central axis and extending between the intersection region and the second axial end of the transverse pathway, wherein the controller is further configured to: i) apply DC bias voltages to the first, second, third, and fourth sets of electrodes such that precursor ions received at the proximal inlet end are trapped in the second portion of the first pathway prior to interacting the at least a portion of the precursor ions with the electrons, ii) thereafter, apply a first auxiliary AC signal to the second set of electrodes while the electron source introduces the plurality of electrons to the transverse pathway such that at least a portion of the precursor ions trapped in the second portion of the first pathway enter the intersection region to interact with the electrons to form product ions, and wherein the electric field in the second portion of the first pathway is configured to trap said product ions removed from the transverse pathway, and iii) thereafter, terminate said first auxiliary AC signal applied to the second set of electrodes, alter said DC bias voltages applied to the first, second, third, and fourth sets of electrodes for mutual storage of positively and negatively charged ions so as to selectively reduce the charge of the product ions to concentrate the product ions at a lower charge state via interaction with the reagent ion. Additionally or alternatively, the controller can be configured to adjust the first, second, third, and fourth sets of electrodes to be the same DC voltage relative to one another. In various aspects, RF signals can be applied to lenses adjacent the ends of the central and transverse pathways so as to prevent both positive cations and negative anions from being ejected from the ion processing device during the mutual storage.

In various aspects, the controller can also be operatively coupled to the ion source and the charged species source for controlling the timing of generation of ions thereby, wherein the controller is configured to control the charged species source so as to generate reagent ions while the precursor ions are undergoing electron capture dissociation, and wherein the DC bias voltages applied to the first, second, third, and fourth sets of electrodes are configured to trap reagent ions in the first portion of the first pathway while said precursor ions are undergoing electron capture dissociation. In some related aspects, the system can further comprise an ion optical element disposed adjacent the inlet end of the first set of electrodes, the ion optical element coupled to the one or more power sources and said controller further configured to apply a DC bias between the ion optical element and the first set of electrodes and a DC bias between the first set of electrodes and electrodes of the third and fourth set of electrodes so as to trap reagent ions in the first portion of the first pathway while said precursor ions are undergoing electron capture dissociation.

The electrodes can have a variety of configurations. By way of example, in some aspects, each of two electrodes of the first set of electrodes can be disposed relative to one electrode from the third set of electrodes in an L-shape, wherein each of the other two electrodes of the first set of electrodes is disposed relative to one electrode from the fourth set of electrodes in an L-shape, wherein each of two electrodes of the second set of electrodes is disposed relative to one electrode from the third set of electrodes in an L-shape, and wherein each of the other two electrodes of the second set of electrodes is disposed relative to one electrode from the fourth set of electrodes in an L-shape.

In some alternative aspects, electrodes of the first and second sets of electrodes are L-shaped electrodes having a longitudinal segment and a transverse segment and wherein the longitudinal segments of each electrode of the first and second sets of electrodes define the first segments of the first and second sets of electrodes, respectively, and the transverse segments of each electrode of the first and second sets of electrodes define the transverse pathway. In related aspects, the system can also comprise a downstream quadrupole rod set disposed distal to the second set of electrodes, the quadrupole rod set defining an ion trapping region therein in communication with the first pathway for receiving product ions therefrom. By way of example, in some related aspects, the controller can be further configured to control at least one of DC and RF voltages applied to at least one of said second set of electrodes and said downstream quadrupole rod set such that product ions removed from the transverse pathway are trapped in the downstream quadrupole rod set prior to interacting with reagent ions to concentrate the product ions at the lower charge state. Additionally, a first ion optical element disposed adjacent the inlet end of the first set of electrodes and a second ion optical element disposed adjacent the outlet end of the second set of electrodes can be provided, wherein the controller is further configured to control at least one of DC and RF voltages applied to at least one of the first and second ion optical elements and the downstream quadrupole rod set so as to transmit product ions trapped in said downstream quadrupole rod set to said first pathway, and thereafter, simultaneously trap said product ions and said reagent ions within said first and transverse pathways while applying an auxiliary AC signal to the first and second sets of electrodes so as to selectively reduce the charge of the product ions.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DETAILED DESCRIPTION

Figure 1:
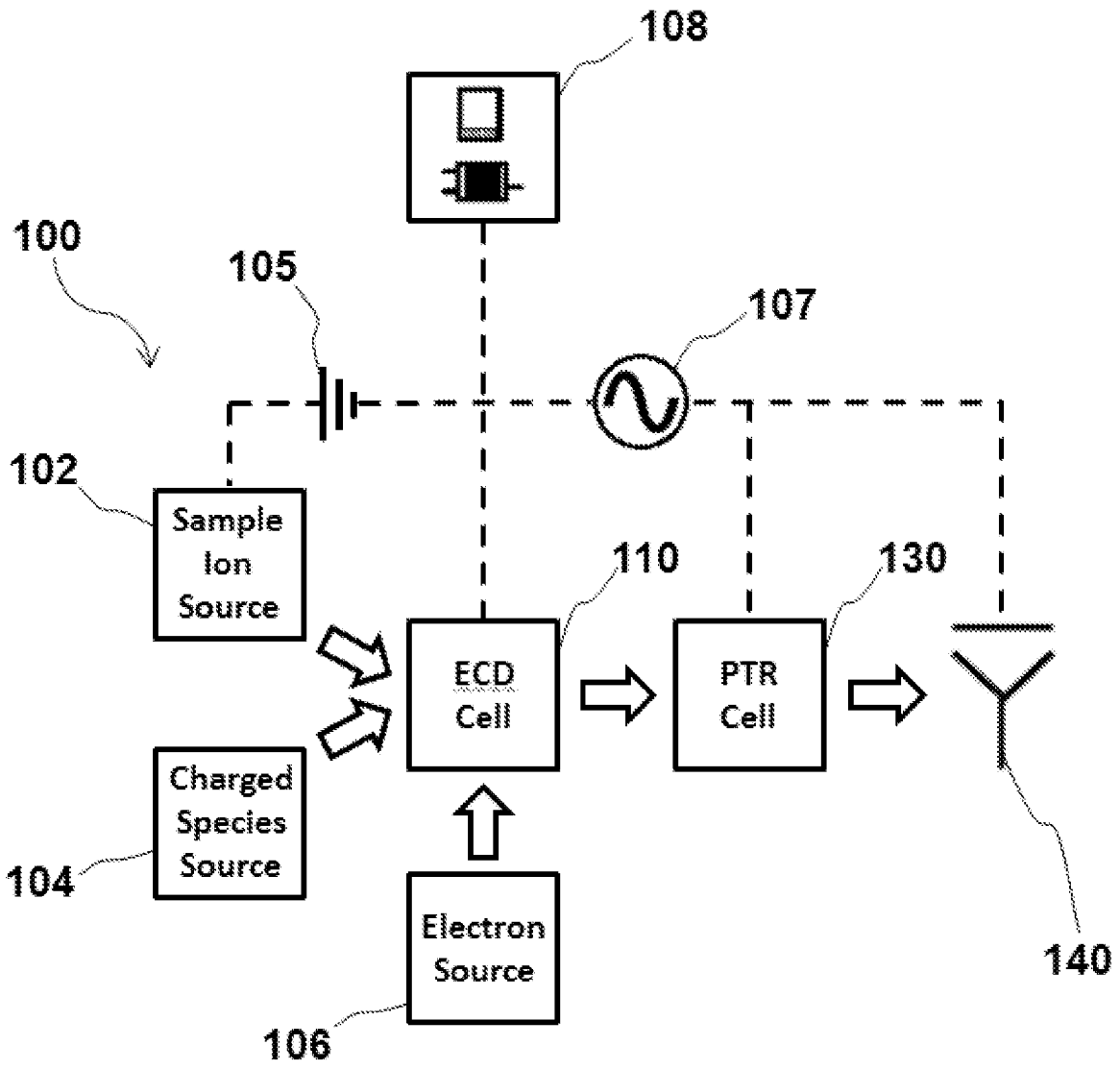
FIG. 1, in a schematic diagram, illustrates an exemplary ECD/PTR mass spectrometer system in accordance with an aspect of various embodiments of the applicant's teachings.

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly it will be apparent that the described embodiments may be susceptible to alteration or variation according to common general knowledge without departing from the scope of the disclosure. The following detailed description of embodiments is not to be regarded as limiting the scope of the applicant's teachings in any manner.

The term "about" and "substantially identical" as used herein, refers to variations in a numerical quantity that can occur, for example, through measuring or handling procedures in the real world; through inadvertent error in these procedures; through differences/faults in the manufacture of electrical elements; through electrical losses; as well as variations that would be recognized by one skilled in the art as being equivalent so long as such variations do not encompass known values practiced by the prior art. Typically, the term "about" means greater or lesser than the value or range of values stated by 1/10 of the stated value, e.g., ±10%. For instance, applying a voltage of about +3V DC to an element can mean a voltage between +2.7V DC and +3.3V DC. Likewise, wherein values are said to be "substantially identical," the values may differ by up to 5%. Whether or not modified by the term "about" or "substantially" identical, quantitative values recited in the claims include equivalents to the recited values, e.g., variations in the numerical quantity of such values that can occur, but would be recognized to be equivalents by a person skilled in the art.

In various aspects, methods and systems are provided herein for analyzing ions so as to enable ECD-based top-down analysis of intact proteins and peptides present in a sample. Whereas conventional methods of MS-based proteomics can result in convoluted data due to the presence of multiple product ions of different masses (e.g., product ions having different numbers of peptides), each of which can be associated with a different number of charge states and/or incomplete sequence information (especially for internal peptide sequences when the product peptide ions are subject to one or more additional multiple dissociation events), the present teachings can be useful for generating a complete sequence for peptide ions utilizing the high dissociation efficiency of ECD, while nonetheless resulting in a less-convoluted mass spectrum. As discussed in detail below, various aspects of the methods and systems disclosed herein can selectively remove product ions resulting from an ECD dissociation event from the interaction region of an ECD reaction cell, while other precursor peptide ions continue to undergo ECD within the interaction region. By way of non-limiting example, methods and systems can provide for the mass-selective extraction of product ions from the interaction region without an auxiliary AC excitation field being generated within the interaction region so as to avoid altering the kinetic energy and/or path of the electrons to the detriment of ECD reaction efficiency. In such a manner, the present teachings can thereby reduce or prevent the occurrence of subsequent electron capture events with the product ions (e.g., secondary or tertiary ECD events) so as to preferentially limit precursor ions to a single dissociation event, thereby predominantly leading to c-type and z-type product ions (e.g., exhibiting different peptide lengths depending on the location of the cleaved bond) that can be subsequently processed to promote protein identification and/or sequencing. By way of example, after generating a plurality of product ions from the ECD, the product ions can be subject to a proton transfer reaction (PTR) via exposure (e.g., simultaneous trapping) with an oppositely-charged reagent ion so as to provide a non-dissociative charge reduction to a lower charge state.

While the systems, devices, and methods described herein can be used in conjunction with many different mass spectrometer systems with fewer, more, or different components than those depicted, an exemplary mass spectrometer system 100 for use in accordance with the present teachings is illustrated schematically in FIG. 1. As shown in the exemplary embodiment depicted in FIG. 1, the mass spectrometer system 100 generally comprises a sample ion source 102 for ionizing a sample containing or suspected of containing one or more analytes of interest (e.g., peptides, proteins) so as to generate a plurality of precursor cations therefrom, an electron source 106 for generating electrons utilized in an ECD reaction with the precursor cations, and a charged species source 104 for generating reagent anions. Additionally, the mass spectrometer system 100 includes an ECD cell 110 having an interaction region within which the precursor cations can interact with the electrons so as to dissociate into a plurality of product ions (e.g., peptides), and a PTR cell 130 within which the product ions can react with reagent anions so as to concentrate the product ions at a lower charge state. As discussed in detail below, the system 100 can preferentially extract the product ions from the interaction region of the ECD cell upon formation, while precursor ions continue to undergo ECD within the reaction cell. Though the ECD cell 110 and PTR cell 130 are depicted in FIG. 1 as separate ion-ion reaction cells, it will be appreciated that in some aspects of the present teachings, the PTR reaction between the product ions and the reagent cations can be performed within the ECD cell 110 itself after the formation of the product ions therein, as discussed below for example with reference to FIGS. 3A-3B.

The sample ion source 102 can have a variety of configurations but is generally configured to generate ions (e.g., cations) from peptides and/or proteins contained within a sample from a sample source (not shown). Suitable sample sources for use in accordance with the present teachings can generally be configured to contain and/or introduce a sample (e.g., a solution containing or suspected of containing a protein or peptide) to the ion source 102 and can, for example, be fluidly coupled to the ion source so as to transmit a liquid sample to the ion source 102 (e.g., through one or more conduits, channels, tubing, pipes, capillary tubes, etc.). By way of non-limiting examples, the sample source can comprise a reservoir of the sample to be analyzed or an input port through which the sample can be injected. In some aspects, for example, the sample source can comprise an infusion pump (e.g., a syringe pump) for continuously flowing the sample into the ion source 102. Alternatively, also by way of non-limiting example, the liquid sample to be analyzed can be in the form of an eluent from an on-line liquid chromatography column, though in some aspects, one or more sample preparation steps (e.g., multi-dimensional LC separations, electrophoresis, di-sulfide bond reduction, etc.) can be performed off-line.

In some exemplary aspects of the present teachings, the ion source 102 can include a conduit in direct or indirect fluid communication with the sample source that terminates in an outlet end that at least partially extends into an ionization chamber. As the liquid sample is discharged from the outlet end into the ionization chamber (e.g., as a plurality of micro-droplets), peptides and/or proteins contained within the micro-droplets can be ionized (i.e., charged) by the ion source 102. As the liquid (e.g., a solvent) within the droplets evaporates, the protein or peptide ions can be released and drawn toward and through an aperture for transmission to the ECD cell 110 (e.g., via one or more mass analyzer elements, DMS, ion optical elements, and/or filtering quadrupoles). It will be appreciated that a number of different devices known in the art and modified in accord with the teachings herein can be utilized as the ion source 102. By way of non-limiting example, the ion source 102 can be an electrospray ionization device, a nebulizer assisted electrospray device, a chemical ionization device, a nebulizer assisted atomization device, a photoionization device, a laser ionization device, a thermospray ionization device, and a sonic spray ionization device.

The charged species source 104 can also have a variety of configurations but is generally configured to generate reagent ions of opposite charge relative to those produced by the ion source. For example, as will be appreciated by the those skilled in the art, ion sources like those discussed above and configured to operate in negative ion mode so as to produce reagent cations can be utilized when the product ions are positively charged. By way of example, the charged species source 104 can include a discharge needle that is negatively charged such that a reagent (e.g., perfluoro-1-octanol or PFO) is deprotonated (e.g., $[PFO-H]^-$ upon being discharged into the ionization chamber.

As shown in FIG. 1, the system 100 can additionally include an electron source 106 for generating and/or introducing electrons into the ECD cell 110 as otherwise discussed herein. Those skilled in the art will appreciate that any electron source suitable for use in a mass spectrometer system for providing electrons for ion-ion reactions and modified in accordance with the present teachings can be utilized in system 100. By way of non-limiting example, electrons can be generated by a filament (e.g., tungsten, thoriated tungsten, and others) or another electron emitter, such as $Y_2O_3$ cathode. In an exemplary operation, an electric current of 1 to 3 A can be applied to heat the electron source, which produces 1 to 10 W heat power so as to generate electrons. It will be appreciated that the electron source 106 can, in some aspects, additionally be associated with a magnetic field generator (e.g., a permanent neodymium magnet or an electromagnet, not shown) to control the path of the electrons within the ECD reaction cell, a photon or light source (e.g., a laser) for activating the ions in activated ions ECD (AI-ECD), and a cooling mechanism (e.g., heat sink, active cooling) to maintain the temperature of a utilized magnet, if present, lower than its Curie temperature, at which the magnetization of permanent magnet is lost. Other known methods of cooling the magnet can also be utilized.

As shown, the system 100 includes a mass spectrometer 140 (e.g., a time-of-flight mass analyzer, an ion trap mass analyzer, a Faraday cup or other ion current measuring device) effective to detect the ions transmitted from the ECD cell 110 and PTR cell 130. As will be appreciated by a person skilled in the art, the system 100 can additionally include any number of additional mass analyzer elements or ion optical elements disposed upstream or downstream of the ECD cell 110 and PTR cell 130 for further ion processing, manipulation, and/or mass analysis. By way of example, ions can be transported through one or more additional differentially pumped vacuum stages (e.g., a first stage maintained at a pressure of approximately 2.3 Torr, a second stage maintained at a pressure of approximately 6 mTorr, and a third stage maintained at a pressure of approximately $10^{-5}$ Torr, with the third cell containing the detector 140 and two or more quadrupole mass analyzers having the ECD cell 110 located therebetween). For instance, in one embodiment, the ECD cell 110 can represent or replace Q2 within a Q-q-Q triple quadrupole mass spectrometer (see e.g., Baba et al., "Electron Capture Dissociation in a Radio Frequency Ion Trap," Anal. Chem. 2004, August 1; 76(15): 4263-6 and PCT Pub. No. WO2014191821 entitled "Inline Ion Reaction Device Cell and Method of Operation," the teachings of each of these exemplary references describing ExD devices incorporated by reference in their entireties).

As shown, the system 100 can additionally include a controller 108 operatively coupled to one or more of the elements of the system 100 so as to control the operation thereof. By way of example, the controller 108 can include a processor for processing information, data storage for storing mass spectra data, and instructions to be executed. As discussed in detail below and as generally known in the art and modified in accordance with the present teachings, the controller 108 can control the generation of ions by the sample ion source 102, reagent ions by the charged species ion source 104, and electrons by the electron source 106 and/or to control the movement of ions into and through the ECD cell 110 and PTR cell 130 via the application of one or more RF/DC voltages to electrodes thereof, by way of example. It will be appreciated that though controller 108 is depicted as a single component, one or more controllers (whether local or remote) can be configured to cause the mass spectrometer system 100 to operate in accordance with any of the methods described herein. Additionally, the controller 108 can also be operatively associated with an output device such as a display (e.g., a cathode ray tube (CRT) or liquid crystal display (LCD), for displaying information to a computer user) and/or an input device including alphanumeric and other keys and/or cursor control, for communicating information and command selections to the processor. Consistent with certain implementations of the present teachings, the controller 108 can execute one or more sequences of one or more instructions contained in data storage, for example, or read into memory from another computer-readable medium, such as a storage device (e.g., a disk). The one or more controller(s) can take a hardware or software form, for example, the controller 108 may take the form of a suitably programmed computer, having a computer program stored therein that may be executed to cause the mass spectrometer system 100 to operate as otherwise described herein, though implementations of the present teachings are not limited to any specific combination of hardware circuitry and software. Various software modules associated with the controller 108, for example, can execute programmable instructions to perform the exemplary methods described below with reference to FIG. 2.

As shown in FIG. 1, the exemplary mass spectrometer system 100 can additionally include one or more power supplies (e.g., DC power supply 105 and RF power supply 107) that can be controlled by the controller 108 so as to apply electric potentials with RF, AC, and/or DC components to electrodes of the various components to configure the elements of the mass spectrometer system 100 in a coordinated fashion and/or for various different modes of operation, as discussed otherwise herein.

Figure 2:
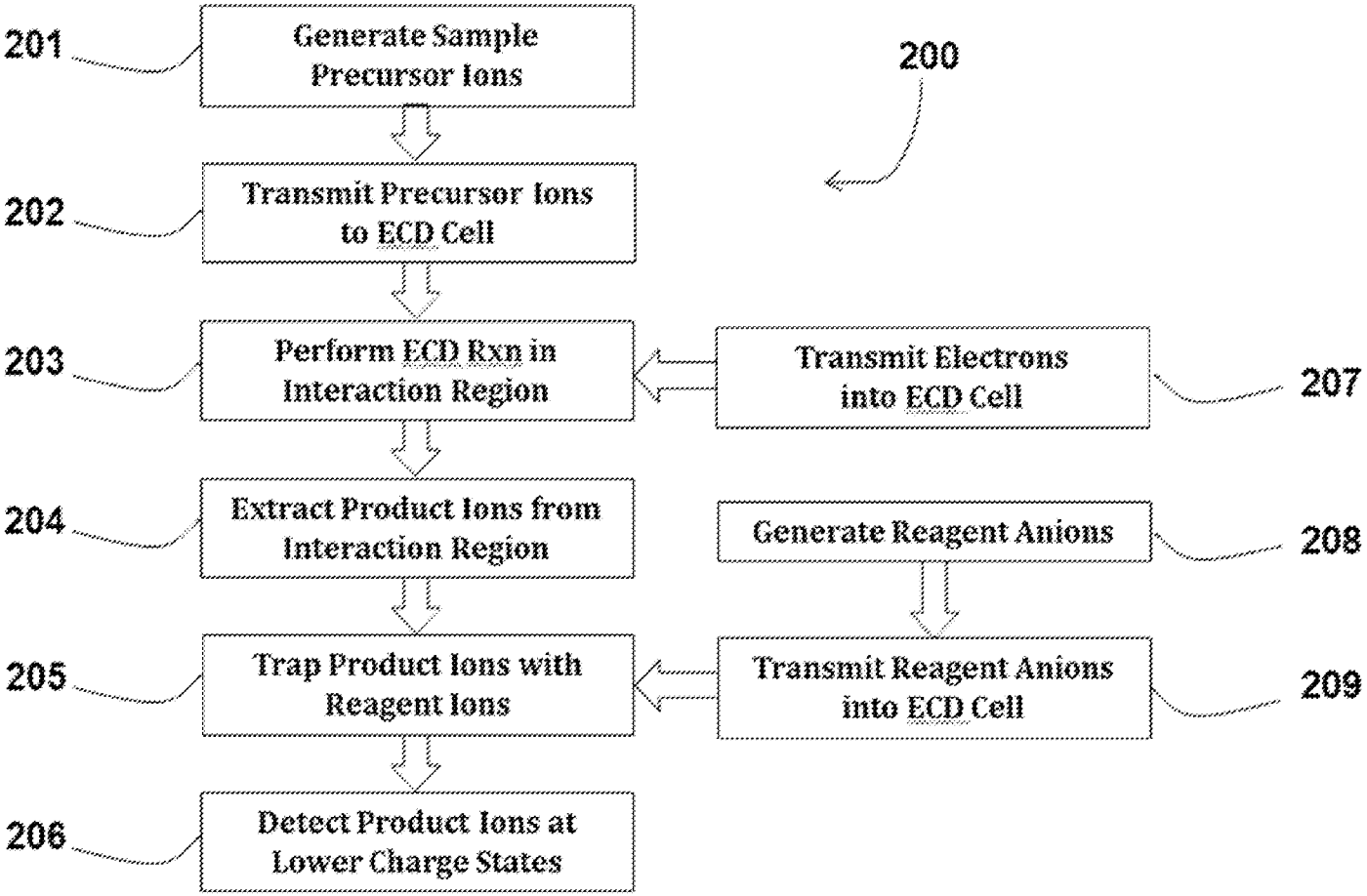
FIG. 2 is a flowchart showing an exemplary method for processing ions in the system of FIG. 1 in accordance with various aspects of the present teachings.

With reference now to FIG. 2, an exemplary method for operating the mass spectrometer system 100 of FIG. 1 in accordance with various aspects of the present teachings is depicted. As shown in step 201, the method 200 can begin by delivering a sample containing a peptide or protein from a sample source to the ion source 102, whereby the sample is ionized as shown in step 201 so as to generate a plurality of peptide and/or protein cations. The precursor cations can then be transmitted to the ECD cell as shown in step 202. In various aspects, one or more mass analyzers upstream from the ECD cell can be operated as a conventional transmission RF/DC quadrupole mass filter that can be operated to select a range of precursor cations of interest for transmission therethrough. By way of example, an upstream quadrupole rod set can be provided with RF/DC voltages suitable for operation in a mass-resolving mode. As will be appreciated by a person skilled in the art, taking the physical and electrical properties of the quadrupole rod set into account, parameters for an applied RF and DC voltage can be selected so that the ECD cell 110 receives precursor cations having an m/z falling within a particular isolation window (e.g., a passband) or this passband can be scanned across a plurality of m/z isolation windows. Additionally, the mass spectrometer system 100 can include one or more additional elements upstream therefrom (e.g., an RF-only focusing ion guide Q0, a differential mobility filter (DMS)). It will also be apparent to those skilled in the art that there may be a number of ion optical elements in the system. In some aspects, the step 202 can comprise trapping the precursor cations within the ECD cell prior to the precursor ions being subject to ECD.

With continued reference to FIG. 2, the exemplary method 200 can comprise performing an ECD reaction within the interaction region (step 203), and in some aspects, preferentially extracting at least a portion of the product ions therefrom while precursor ions remain within the interaction region (204). That is, as the precursor ions are exposed to the electrons generated and/or introduced by the electron source 106 into the ECD cell 110 in step 207, product ions generated in the interaction region through their interaction with the electrons can be selectively extracted from the interaction region (e.g., as in FIGS. 3A-3B), and in some aspects from the ECD cell altogether (e.g., as in FIGS. 4 and 5), to be trapped separate from the interaction region. Two product ions (c and z fragments) together from the same precursor ion can exhibit higher m/z than m/z of the precursor ions because one less positive charge is associated with the product ions following the ECD reaction. Because of this aspect, it can be preferable to extract those ions from the interaction region having a higher m/z ratio. In this manner, the interaction region of the ECD cell 110 can be configured to operate similar to a high-pass filter as the electrons are transmitted through the interaction region in that product ions having an m/z ratio greater than a selected value (e.g., corresponding to a typical mass and charge state for a precursor ion of interest) can be removed from the interaction region, while as yet unreacted precursor ions continue to be exposed to electrons in the interaction region, thereby reducing the potential for the product ions to be subject to additional electron capture events (e.g., a secondary or tertiary dissociation event). Importantly, because a small amplitude auxiliary AC field within the interaction region can alter the kinetic energy of the electrons to the detriment of the ECD reaction efficiency, the steps 203 and 204 are preferably performed in a quadrupole RF field without an auxiliary AC field being generated within the interaction region.

Following the ECD reaction, methods in accordance with various aspects of the present teachings can include a step of concentrating the extracted product ions at a lower charge state. For example, as shown in FIG. 2, the method 200 can include a step 205 in which product cations are trapped with reagent anions in the ECD cell 110 or a separate PTR cell 130 as shown in FIG. 1 such that at least the product ions undergo a non-dissociative charge reduction via a proton transfer reaction (PTR). The reagent anions can be generated in step 208 by the charged species source 104 of FIG. 1 and transmitted into the ECD cell 110 for a PTR reaction therein or into and through the ECD cell 110 for reaction with the product ions in a downstream ion trap operated as a PTR cell 130 in step 209, for example. As will be discussed in detail below, the selective application of RF and DC potentials to the ECD cell 110 in accordance with some aspects of the present teachings can enable the reagent anions to be generated and trapped within a portion of the ECD cell 110 separate from the precursor and product ions as the precursor ions are undergoing ECD, for example, with the potentials being adjusted after the ECD reaction such that the precursor cations and reagent anions can interact with the ECD cell 110. Alternatively, in some aspects, the charged species source 104 can be activated following the generation of product ions via ECD, with the reagent anions being transmitted into the ECD cell 110 or PTR cell 130 having the product ions trapped therein.

After concentrating the product ions at a lower charge state in step 205, method 200 further includes one or more steps 206 of further processing and/or detecting the product ions of the same m/z, for example, by a downstream mass analyzer, CID cell (e.g., as in $MS^2$), and/or detector (e.g., a TOF detector). By subjecting the precursor ions to a single ECD reaction such that c-type and z-type product ions are preferentially generated (i.e., via selective extraction of product ions) and thereafter reducing the charge state of the product ions, the exemplary method 200 can generate a less-convoluted mass spectrum providing a more complete sequence of the precursor protein or peptide.

Figure 3A:
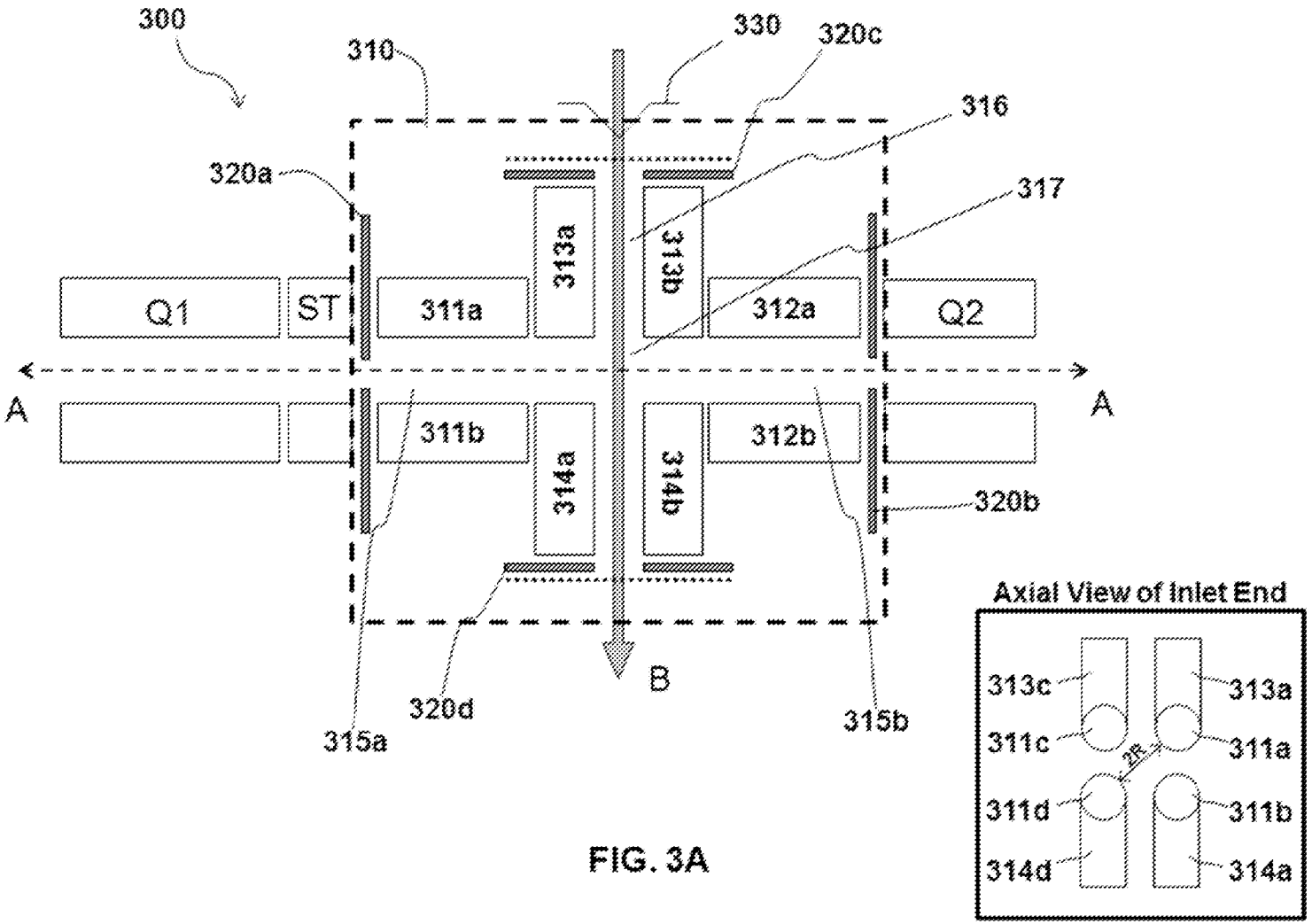
FIGS. 3A-3D depict a partial view of an exemplary system 300 and a schematic for performing the exemplary method of FIG. 2 in accordance with various aspects of the present teachings.

With reference now to FIGS. 3A-3D, a partial view of an exemplary system 300 and a schematic for performing the exemplary method of FIG. 2 in accordance with various aspects of the present teachings are depicted. As best shown in FIG. 3A, the system 300 generally includes an electron source 330 and an ECD cell 310 having a plurality of electrodes that are arranged so as to define a central longitudinal axis (A) and a transverse axis (B). As shown, the system 300 can additionally include an upstream quadrupole rod set Q1 (disposed between the ion source(s) and the ECD cell 310) and a downstream quadrupole rod set Q2 (disposed between the ECD cell 310 and a detector). In various aspects, the ECD cell 310 can be housed within a vacuum chamber (e.g., at sub-atmospheric pressures), with a gas such as helium (He) or nitrogen ($N_2$) being added to slow the precursor ions' movement within the ECD cell so as to lengthen the interaction time between the precursor ions and the electrons within the interaction region. Typically, the pressure of the cooling gas can be between $10^{-2}$ to $10^{-4}$ Torr, by way of non-limiting example. Additionally, a magnetic field source, such as a permanent magnet can be configured to generate a magnetic field that is parallel to the transverse passage 316, as depicted schematically for example by the arrow (B). The magnetic field can also be generated by any other magnetic field generating source and can also include an electromagnetic, a neodymium magnet, or the like that functions to generate a field parallel to and in line with the second central axis (B) of the second pathway. The magnetic flux density can be any density able to implement the magnetic field to cause focusing of an electron beam and can range, for example, up to 1.5 T, but preferably about 0.1 to 1.0 T. Magnets with higher density can be positioned further away from the electrode pair. A magnetic field (as indicated by the arrow B) of 0.1 T is aligned to be parallel to and along the path of electron direction.

As shown in FIG. 3A, the exemplary ECD cell 310 comprises 4 sets of electrodes 311-314, each of which is arranged in a quadrupole orientation about one of the two axes. That is, each set of electrodes 311-314 comprise four parallel conductive rods or elongated electrodes arranged such that their centers form the corners of a square and whose opposing poles can be electrically connected (e.g., for a typical quadrupole field a superposition of a static DC potential and a sinusoidal RF potential with the phase of adjacent electrodes being opposite to one another). Specifically, as shown in FIG. 3A, a first set 311 of four electrodes 311*a-d* are disposed about the central longitudinal axis (A) so as to define a portion 315*a* of an axial passageway. The first set 311 of electrodes extend axially therealong from an inlet end through which precursor ions generated by an upstream sample ion source (not shown, e.g., via Q1) can be received to a distal end within the ECD cell 310. A second set 312 of four electrodes 312*a-d* (of which only electrodes 312*a* and 312*b* are shown) are also disposed about the central longitudinal axis (A) so as to define a second portion 315*b* of the axial passageway. As shown, the second set 312 of electrodes are spaced apart from the first set 311 of electrodes such that the transverse axis (B) extends between the distal end of the first set 311 of electrodes and the proximal end of the second set 312 of electrodes. As shown, the second set 312 of electrodes extend from the proximal end to a distal end through which ions can be ejected from the ECD cell 310 to one or more mass analyzers (e.g., Q2 via exit lens IQ3) or a detector, for example. Additionally, a third set 313 of electrodes 313*a-d* and fourth set of 314 of electrodes 314*a-d* (in each set only two of the four electrodes are shown) are disposed about the transverse axis (B), with each set being disposed about in a quadrupole orientation on opposite sides of the central longitudinal axis (A). By this arrangement, each electrode of the first set 311 generally forms an L-shape with one of the electrodes of the third set 313 or fourth set 314, while each electrode of the second set 312 generally forms an L-shape with an electrode of the third set 313 or fourth set 314. Thus, as shown, the first and second sets 311, 312 at least partially define the axial passageway and the third and fourth sets 313, 314 at least partially define a transverse passage 316 that intersects with the axial passageway 315 at an intersection region 317.

It will be appreciated by those skilled in the art that the electrodes of the first, second, third, and fourth sets can have a variety of shapes and sizes but are generally configured to generate a quadrupole field within the portion of the passageway each set surrounds when an appropriate RF signal is applied to the electrodes of each set. By way of non-limiting example, each electrode can have a longitudinal dimension (e.g., a dimension along the central longitudinal axis (A) for electrodes 311*a-d* and along the transverse axis (B) for electrodes 313*a-d*) in a range of about 3 cm, and a transverse dimension (e.g., a width or radius, a dimension perpendicular to the central longitudinal axis (A) for electrodes 311*a-d* and perpendicular to the transverse axis (B) for electrodes 313*a-d*) in a range of about 5 mm or greater. As shown in the inset of FIG. 3A, in some aspects, each electrode can be radially separated from its opposed electrode in that set (e.g., the non-adjacent electrode across the central longitudinal axis (A) for each electrode 311*a-d*) by a distance (2R), where R is in a range of about 2 mm to about 10 mm.

With continued reference to FIG. 3A, the ECD cell 310 can further include a plurality of lenses 320*a-d*, each of which can be in the form of a conductive plate having a central orifice through which ions or electrons can be transmitted. As shown, the lenses 320*a-d* can be disposed in proximity to the inlet or outlet ends of the various sets of electrodes discussed above. For example, lens 320*a* can function as an ion injection port through which ions can enter the ECD cell and lens 320*b* can function as the ion ejection port through which ions (e.g., product ions as discussed below) can exit the ECD cell 310 after dissociation and/or following PTR. As discussed otherwise herein, RF and/or DC potentials can be applied to the various lenses 320*a-d* for controlling the movement of ions within the ECD cell 310. For example, as discussed in more detail below, various RF and/or DC signals can be applied to lenses 320*a* and 320*b* during various phases of ion processing to facilitate axial trapping of the ions within portions of the space between the electrodes or to facilitate the injection and ejection of ions into and out of the ECD cell 310. Similarly, lens 320*c* and lens 320*d* can be biased (e.g., via application of an appropriate DC voltage) to block the exit of the ions within the transverse pathway 316.

In various aspects of the present teachings, Q1 can be operated as a conventional transmission RF/DC quadrupole mass filter operative to select an ion of interest and/or a range of ions of interest. By way of example, the quadrupole rod set Q1 can be provided with RF/DC voltages suitable for operation in a mass-resolving mode. As will be appreciated by a person skilled in the art, taking the physical and electrical properties of Q1 into account, parameters for an applied RF and DC voltage can be selected so that Q1 establishes a quadrupole field having an m/z passband selected to allow particular precursor cations (e.g., exhibiting an m/z falling within a particular range) to traverse the quadrupole field largely unperturbed, while ions having m/z ratios falling outside the passband can be degenerated by the quadrupole field into orbital decay. It should be appreciated that this mode of operation is but one possible mode of operation for Q1. As shown, in some embodiments, a set of RF-only stubby rods can be provided between neighboring pairs of quadrupole rod sets to facilitate the transfer of ions between quadrupoles. The stubby rods can serve as a Brubaker lens and can help prevent ions from undergoing orbital decay due to interactions with any fringing fields that may have formed in the vicinity of an adjacent lens, for example, if the lens is maintained at an offset potential. By way of non-limiting example, FIG. 3A depicts stubby rods ST between Q1 and lens 320*a* to focus the flow of ions into the first portion 315*a* of the axial passage. Similarly, ions (e.g., product ions) that are transmitted by the ECD cell 310 can pass into the adjacent quadrupole rod set Q2, which can be bounded upstream by lens 320*b*. As will be appreciated by a person skilled in the art, Q2 can be operated in a number of manners, for example as a PTR cell, as a cell for performing collision-induced dissociation (e.g., as in $MS^2$, as a scanning RF/DC quadrupole, as a quadrupole ion trap, or as a linear ion trap.

Figures 3B, 3C, 3D:
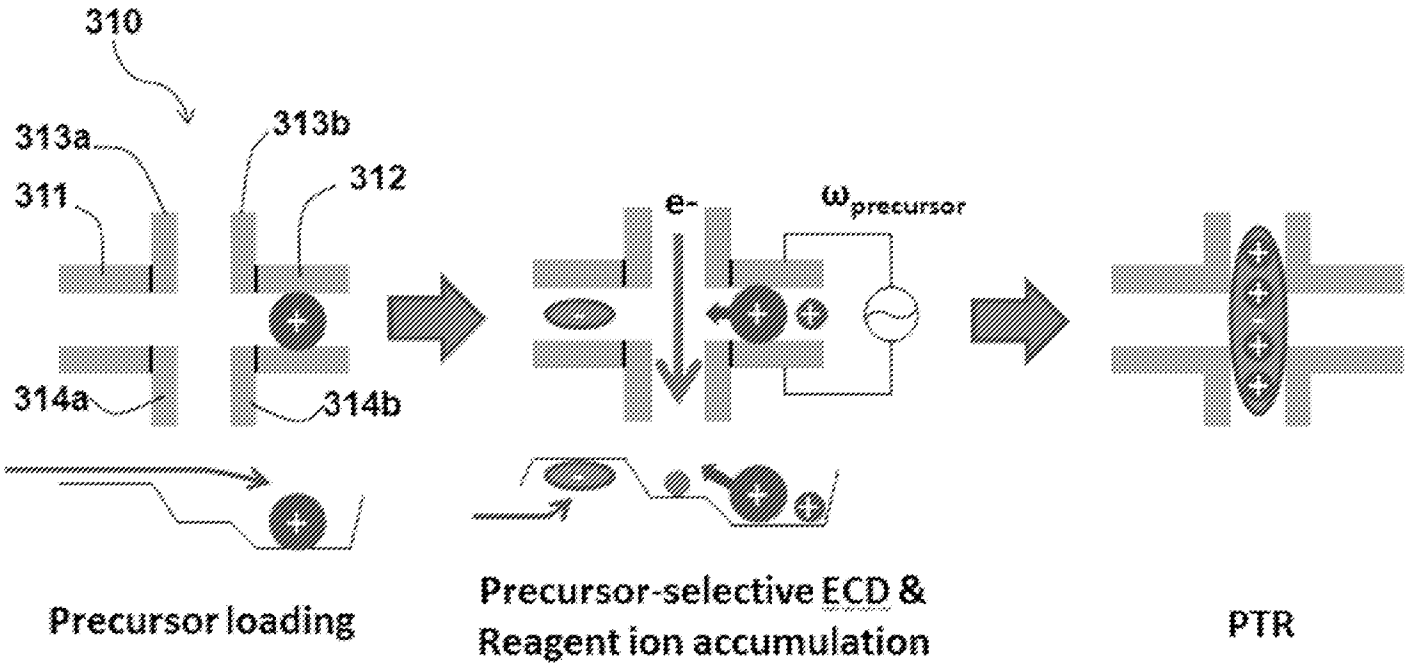

With specific reference now to FIG. 3B-D, a schematic for performing the exemplary method of FIG. 2 utilizing the ECD cell 310 of FIG. 3A in accordance with various aspects of the present teachings is depicted. As noted above with reference to step 202 of FIG. 2, after precursor cations are generated, they can be transmitted through Q1 (e.g., operating in passband mode) and into the ECD cell 310, in which they can be trapped within the second portion 315*b* of axial pathway via the selective application of RF and/or DC signals to the various electrodes and lenses of the ECD cell. For example, as shown in FIG. 3B, during a precursor loading stage, the electrodes of the first, second, third, and fourth set of electrodes can have RF signals applied thereto (for radial focusing along the central longitudinal axis or transverse axis), while a DC gradient can be generated so as to form a potential well in the second portion 315*b* of the axial pathway to trap the cations therein. By way of example, as indicated by the schematic of the DC electric field on the central longitudinal axis (A) during the precursor loading stage, the first set 311 of electrodes can be maintained at a first DC offset; the electrodes (e.g., 313*a*, 314*a*) of the third and fourth sets of electrodes 313, 314 on the inlet (upstream) side of the transverse pathway 316 can be maintained at a second DC offset that is more attractive to the cations relative to first DC offset; the electrodes (e.g., 313*b*, 314*b*) of the second and third sets 313, 314 of electrodes on the outlet (downstream) side of the transverse pathway 316 can be maintained at a third DC offset that is more attractive to the cations relative to second DC offset; the second set of electrodes can be maintained at a fourth DC offset that is more attractive to the cations relative to third DC offset; and the lens 320*b* can be maintained at a repulsive DC potential to block the exit of the cations therethrough. In this manner, precursor cations entering the inlet end of the ECD cell 310 can be transmitted to the second portion of the axial pathway 315 and can be trapped therein. It will be appreciated in light of the teachings herein that such a configuration is but one example of applying RF and DC signals to the electrodes of the ECD cell 310 during the precursor loading stage. By way of example, precursor ions can alternatively be trapped within the first portion 315*a* of the axial pathway, for example, by maintaining the electrodes (e.g., 313*a*, 314*a*) of the third and fourth sets of electrodes 313, 314 on the inlet (upstream) side of the transverse pathway 316 at a repulsive DC offset relative to DC offset of the first set 311. Such a configuration, however, may not enable reagent anions to be generated and/or transmitted into the ECD cell 310 until after the ECD reaction is completed in order to avoid premature PTR reactions between the reagent anions and precursor/product cations.

With reference now to FIG. 3C, after trapping the precursor cations within the second portion 315*b* of the axial pathway 315, the signals applied to the electrodes of the ECD cell 310 can be adjusted so as to promote precursor-selective ECD. Specifically, as shown in the schematic, an auxiliary AC signal can be applied to the four electrodes 312*a-d* of the second set 312 so as to resonantly excite the precursor ions trapped therein. As will be appreciated by those skilled in the art in light of the present teachings, the auxiliary AC signal can comprise, for example, a sinusoidal potential applied to the four electrodes 312*a-d*, with the frequency being selected to correspond to the secular frequency of the precursor cations (i.e., $\omega_{precursor}$). In this manner, precursor cations can gain sufficient kinetic energy to overcome the DC field such that the precursor cations enter the intersection region 317 due to their increased motion in the ECD cell 310. While this auxiliary AC signal is being applied, the electron source 310 can be activated such that electrons are transmitted through the intersection region 317 to allow the electrons and the precursor cations to interact thereat. If an ECD event occurs within the intersection region, the product ions formed thereby would then be extracted into and trapped within the second portion 315*b* of the axial pathway because the auxiliary AC signal would not resonantly excite the product ions of different m/z relative to the precursor ions. Thus, precursor ions can continue to preferentially undergo ECD reactions, while previously formed product ions avoid secondary or tertiary ECD events. It will further be appreciated by those skilled in the art that in the exemplary ECD reaction step depicted in FIG. 3C, the auxiliary AC field generated by the second set of electrodes is substantially confined to the second portion 315*b* of the axial pathway 315 such that electrons transmitted along the transverse pathway 316 would not be affected thereby to the detriment of the ECD reaction efficiency, as otherwise discussed herein.

Additionally, as shown in FIG. 3C and noted above, the ECD cell 310 can enable reagent anions to be trapped within the ECD cell 310 while the precursor ions undergo ECD. For example, as shown schematically in the plot of the average potential of the electric field along the central longitudinal axis, the DC signal applied to lens 320*a* can be adjusted (i.e., made repulsive to the negative reagent ions) such that reagent anions settle and are trapped within the potential well generated within the first portion 315*a* of the axial passage 315.

With reference now to FIG. 3D, upon termination of the ECD reaction period (e.g., electron source turned off, auxiliary AC signal having $O_{precursor}$ discontinued), exemplary methods in accordance with various aspects of the present teaching provide for the interaction of the reagent anions and product cations in a non-dissociative manner such that the charge state of product ions can be reduced. By way of example, the signals applied to the electrodes of the ECD cell 310 can be adjusted such that the reagent anions trapped in the first portion 315*a* of the axial passage 315 and the product cations trapped in the second portion 315*b* can interact in a PTR process. Specifically, each of the first, second, third, and fourth sets of electrodes can be adjusted to an identical DC offset (e.g., turn off axial DC trapping voltages), while the radial trapping RF voltages remain on. Similarly, the lenses 320*a-d* can have an RF signal applied thereto so as to prevent ions from being ejected from the ECD cell 310. In this manner, both the product cations and reagent anions can traverse both the axial passage 315 and transverse passage 316, thereby allowing them to mix and interact with one another so as to enable non-dissociative charge reduction. As discussed above with reference to FIG. 2, after concentrating the product ions at a lower charge state in step 205, the product ions can then be ejected from the trap for further processing and/or detection.

Figure 4:
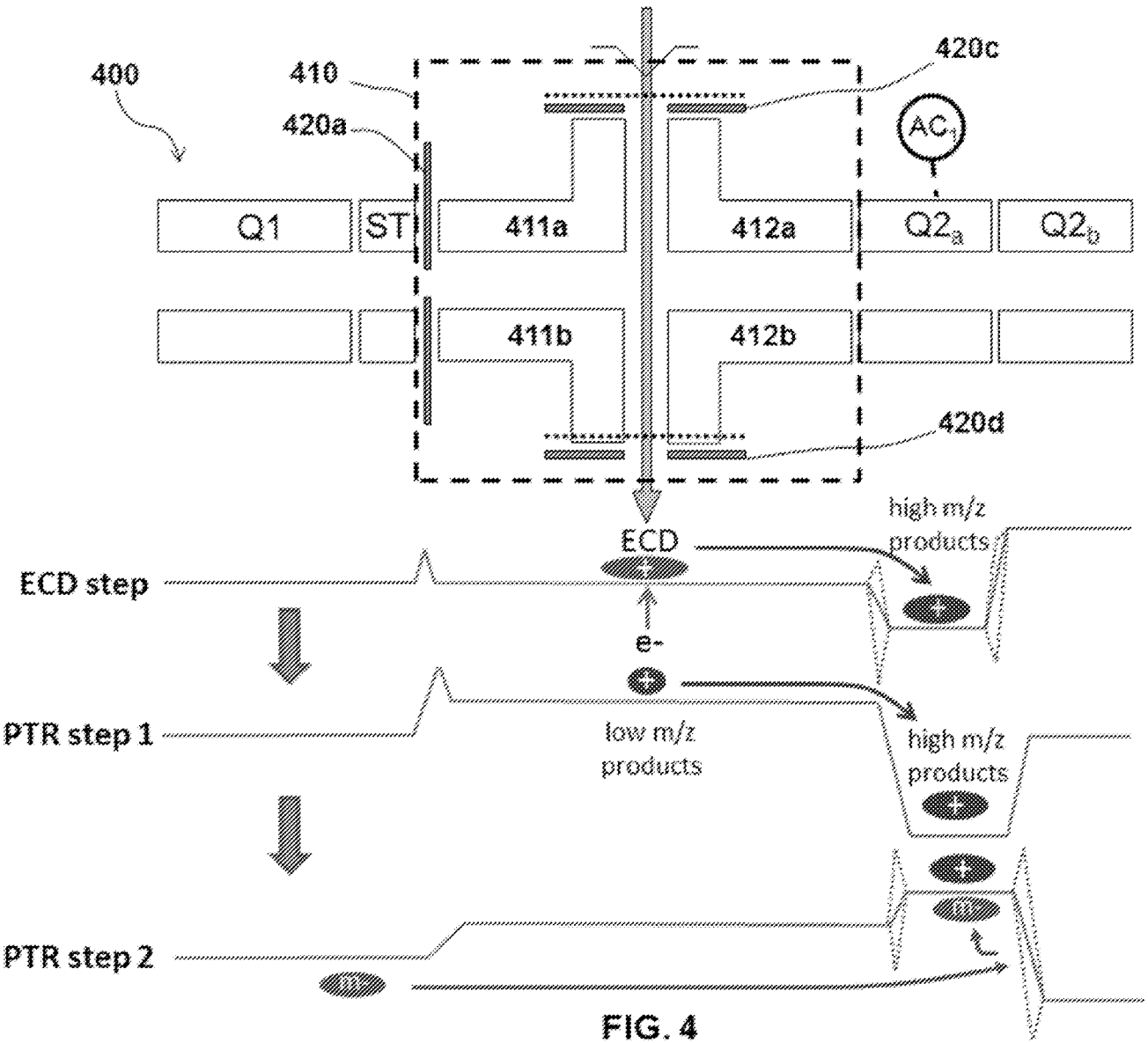
FIG. 4 depicts a partial view of another exemplary system 400 and a schematic for performing the exemplary method of FIG. 2 in accordance with various aspects of the present teachings.

With reference now to FIG. 4, a partial schematic view of another exemplary system 400 in accordance with various aspects of the present teachings is depicted. As shown, system 400 is similar to system 300 but differs in that the ECD cell 410 instead comprises two sets of electrodes 411, 412 that together define the axial passage and the transverse passage. Specifically, rather than each of the electrodes 311*a-d* being electrically isolated from and forming a general L-shape with one of the adjacent electrodes from the third and fourth sets as shown in the inset of FIG. 3A such that the signals applied thereto can differ from one another during the exemplary methods described above, the electrodes 411*a-d* are instead in the form of continuous L-shaped electrodes. That is, the portion of the electrode 411*a*, for example, that extends along the central longitudinal axis and the portion of the electrode 411*a* that extends along the transverse axis are always maintained at the same potential. By this arrangement and with the proper application of RF voltages (e.g., a sinusoidal RF potential with the phase of each adjacent electrode within and between sets 411*a,b* being opposite to one another), a quadrupole field can be generated in each of the axial and transverse passages.

As with FIG. 3A, the system 400 likewise includes at least one downstream quadrupole rod set Q2*a* and Q2*b* disposed between the ECD cell 410 and a detector, but differs in that there is not an exit lens disposed between the outlet end of the second set 412 of electrodes and Q2*a*. Rather, the ECD cell 410 includes lenses 420*a,c,d*, each of which can be in the form of a conductive plate having a central orifice through which ions or electrons can be transmitted. As above, lens 420*a* can function as an ion injection port through which ions can enter the ECD cell 410, while lens 420*c* and lens 420*d* can be biased (e.g., via application of an appropriate DC voltage) to block the exit of the ions within the transverse pathway. As discussed otherwise herein, RF and/or DC potentials can be applied to the L-shaped rods of the first and second sets 411, 412 of electrodes, the various lenses 420*a,c,d*, Q2*a*, and Q2*b* for controlling the movement of ions within the system 400. For example, as discussed in more detail below, various RF and/or DC signals can be applied to Q2*a* during various phases of ion processing to facilitate removal of product ions having higher m/z ratios from the ECD cell 410 during the ECD-induced generation of product ions.

Operation of the system 400 in accordance with various exemplary aspects of the present teachings will now be described with reference to the exemplary electric field diagrams, which depict the exemplary electric field strength on the central longitudinal axis at axial positions along the ion travel pathways. As discussed above with reference to step 202 of FIG. 2, after precursor cations are generated and transmitted through Q1 (e.g., operating in passband mode), the precursor cations can be trapped in the ECD cell 410 via the selective application of an RF signal to the electrode sets 411, 412 and a DC blocking potential to lenses 420*a,c,d* (i.e., the lenses 420*a,c,d* are more repulsive to the cations relative to the electrodes 411*a-b* and 412*a-b*). Additionally, the downstream rod set Q2*a* can be maintained at a DC offset more repulsive to the precursor cations during the loading stage.

As shown in FIG. 4, at the initiation of the ECD step (e.g., upon the activation of the electron source and the interaction of cations trapped within the ECD cell 410 with the electrons in the transverse passage), the DC offset applied to Q2*a* can be adjusted to be more attractive to the cations while simultaneously an auxiliary AC signal is applied thereto. As will be appreciated by those skilled in the art in light of the present teachings, the AC signal can be selected (e.g., by adjusting the amplitude) so as to alter the pseudopotential well depth generated in Q2*a*, roughly approximated as follows:

$$ze \cdot C\frac{U_{AC}^2}{\omega^2\left(\frac{m}{z}\right)} \approx ze \cdot (V_{ECD} - V_{Q2a})$$

(see e.g., Loboda et al. "A Novel Ion Trap That Enables High Duty Cycle And Wide m/z Range on an Orthogonal Injection TOF Mass Spectrometer," J Am Soc Mass Spectrom 2009, 20 1342-48 (Mar. 2009), the teachings of which is incorporated by reference in its entirety). Without being bound by any particular theory, because precursor ions and product ions of lower m/z may not have sufficient energy to overcome the strength of the pseudopotential well, ions of higher m/z (i.e., product ions having m/z greater than the precursor ions) are preferentially extracted into Q2*a*. In this manner, the superposition of the AC signal on Q2*a* can represent a high-pass filter that can be adjusted, for example, so as to prevent higher m/z product ions from being subjected to additional ECD events.

Upon termination of the ECD reaction period (e.g., when the electron source is turned off), ions remaining in the ECD reaction region can be transferred to Q2*a* by removing the AC amplitude applied to Q2*a* (e.g., setting the AC amplitude to 0). The AC signal applied to Q2*a* can then be turned on again while the DC signal applied to the electrodes of Q2*a* is made attractive to the reagent ions. The charged species source can then be activated to generate reagent anions that are transferred through the system 400 to be simultaneously trapped within Q2*a* such that the product ions can undergo PTR therewith. After the end of the PTR period during which the product ions are concentrated at a lower charge state (e.g., step 205 of FIG. 2), the product ions can then be ejected from Q2*a* for further processing and/or detection.

It should be appreciated that numerous changes can be made to the disclosed embodiments without departing from the scope of the present teachings. While the foregoing figures and examples refer to specific elements, this is intended to be by way of example and illustration only and not by way of limitation. It should be appreciated by the person skilled in the art that various changes can be made in form and details to the disclosed embodiments without departing from the scope of the teachings encompassed by the appended claims.

The invention claimed is:

1. A system for analyzing ions, comprising:

an ion source adapted to ionize a sample containing one or more analytes of interest so as to generate a plurality of precursor cations therefrom;

a charged species source adapted to generate reagent anions;

a first set of electrodes at least a first segment of which is arranged in a quadrupole orientation about a first central axis, wherein said first segment of the first set of electrodes extends axially along said first central axis from a proximal inlet end to a distal end so as to define a first portion of a first pathway extending along said first central axis, said proximal inlet end for receiving said precursor cations from said ion source and said reagent anions of the opposite polarity from the precursor cations from said charged species source;

a second set of electrodes at least a first segment of which is arranged in a quadrupole orientation about the first central axis so as to define a second portion of the first pathway, wherein said first segment of the second set of electrodes extends axially along said first central axis from a proximal end to a distal outlet end, the proximal end of the second set of electrodes being spaced apart from the distal end of the first set of electrodes such that a transverse pathway extends between the proximal end of the second set of electrodes and the distal end of the first set of electrodes, said transverse pathway extending from a first axial end to a second axial end along a second central axis substantially orthogonal to the first central axis and intersecting with the first pathway at an intersection region;

an electron source disposed proximate to one of the first and second axial ends of the transverse pathway for introducing a plurality of electrons along the second central axis such that said electrons travel through said transverse pathway toward said intersection region;

one or more power sources for providing DC and RF voltages to said first and second sets of electrodes and to generate an electric field in each of the first and transverse pathways; and a controller for controlling said DC and RF voltages applied to each of the first and second set of electrodes, said controller configured:

i) to generate an RF quadrupole field in the transverse pathway while the electron source introduces a plurality of electrons therealong such that at least a portion of the precursor cations in the intersection region interact with the electrons to dissociate to form product ions via electron capture dissociation, ii) to generate an extraction electric field in at least the second portion of the first pathway such that product ions are preferentially removed from the intersection region upon formation and unreacted precursor cations are not removed from the intersection region, and iii) thereafter, to generate an electric field in the first and second portions of the first pathway such that reagent anions received at the inlet end of the first pathway are transmitted along the first pathway, said reagent anions for selectively reducing the charge of the product ions to concentrate the product ions at a lower charge state.

2. The system of claim 1, further comprising:

a third set of electrodes arranged in a quadrupole orientation about the second central axis and extending between the first axial end of the transverse pathway and the intersection region; and a fourth set of electrodes arranged in a quadrupole orientation about the second central axis and extending between the intersection region and the second axial end of the transverse pathway, wherein the controller is further configured to:

i) apply DC bias voltages to the first, second, third, and fourth sets of electrodes such that precursor cations received at the proximal inlet end are trapped in the second portion of the first pathway prior to interacting the at least a portion of the precursor cations with the electrons, ii) apply a first auxiliary AC signal to the second set of electrodes while the electron source introduces the plurality of electrons to the transverse pathway such that at least a portion of the precursor cations trapped in the second portion of the first pathway enter the intersection region to interact with the electrons to form product ions, and wherein the electric field in the second portion of the first pathway is configured to trap said product ions removed from the transverse pathway, and iii) thereafter, terminate said first auxiliary AC signal applied to the second set of electrodes and alter said DC bias voltages applied to the first, second, third, and fourth sets of electrodes to provide for the mutual storage of positively and negatively charged ions so as to selectively reduce the charge of the product ions to concentrate the product ions at a lower charge state via their interaction with the reagent anion.

3. The system of claim 2, wherein the first auxiliary AC signal applied to the second sets of electrodes exhibits a frequency corresponding to the secular frequency of the precursor cations.

4. The system of claim 2, wherein the controller is operatively coupled to the ion source and charged species source for controlling the timing of generation of ions thereby, wherein the controller is configured to control the charged species source so as to generate reagent anions while the precursor cations are undergoing electron capture dissociation, and wherein the DC bias voltages applied to the first, second, third, and fourth sets of electrodes are configured to trap reagent anions in the first portion of the first pathway while said precursor cations are undergoing electron capture dissociation.

5. The system of claim 2, wherein each of two electrodes of the first set of electrodes is disposed relative to one electrode from the third set of electrodes in an L-shape, wherein each of the other two electrodes of the first set of electrodes is disposed relative to one electrode from the fourth set of electrodes in an L-shape, wherein each of two electrodes of the second set of electrodes is disposed relative to one electrode from the third set of electrodes in an L-shape, and wherein each of the other two electrodes of the second set of electrodes is disposed relative to one electrode from the fourth set of electrodes in an L-shape.

6. The system of claim 5, further comprising an ion optical element disposed adjacent the inlet end of the first set of electrodes, the ion optical element coupled to the one or more power sources and said controller further configured to apply a DC bias between the ion optical element and the first set of electrodes so as to trap reagent anions in the first portion of the first pathway while said precursor cations are undergoing electron capture dissociation.

7. The system of claim 1, wherein an auxiliary AC excitation field is not generated within the transverse pathway while the electron source introduces a plurality of electrons therealong.

8. The system of claim 1, wherein product ions are mass-selectively removed from the intersection region upon formation.

9. The system of claim 1, wherein the electrodes of the first and second sets of electrodes are L-shaped electrodes having a longitudinal segment and a transverse segment and wherein the longitudinal segments of each electrode of the first and second sets of electrodes define the first segments of the first and second sets of electrodes, respectively, and the transverse segments of each electrode of the first and second sets of electrodes define the transverse pathway.

10. The system of claim 9, further comprising a downstream quadrupole rod set disposed distal to the second set of electrodes, said quadrupole rod set defining an ion trapping region therein in communication with the first pathway for receiving product ions therefrom, wherein the controller is further configured to control at least one of DC and RF voltages applied to at least one of said second set of electrodes and said downstream quadrupole rod set such that product ions removed from the transverse pathway are trapped in said downstream quadrupole rod set prior to interacting with reagent anions.

11. The system of claim 10, wherein said controller is further configured to control at least one of DC and RF voltages applied to the downstream quadrupole rod set so as to provide for the mutual storage of positively and negatively charged ions therein so as to selectively reduce the charge of the product ions.

12. A method of analyzing ions using an ion processing device, comprising:

receiving precursor cations generated by an ion source of the ion processing device through a proximal inlet end of the ion processing device;

introducing electrons into an interaction region of said ion processing device such that the electrons interact with precursor cations within said interaction region to form product ions via electron capture dissociation, and applying an extraction electric field such that said product ions are preferentially removed from the interaction region upon formation and unreacted precursor cations are not removed from the interaction region;

receiving reagent anions generated by a charged species source of the ion processing device through the proximal inlet end of the ion processing device; and applying an electric field to interact said product ions with said reagent anions so as to concentrate the product ions at a lower charge state;

wherein the ion processing device comprises:

a first set of electrodes at least a first segment of which is arranged in a quadrupole orientation about a first central axis, wherein said first segment of the first set of electrodes extends axially along said first central axis from the proximal inlet end to a distal end so as to define a first portion of a first pathway extending along said first central axis;

a second set of electrodes at least a first segment of which is arranged in a quadrupole orientation about the first central axis so as to define a second portion of the first pathway, wherein said first segment of the second set of electrodes extends axially along said first central axis from a proximal end to a distal outlet end, the proximal end of the second set of electrodes being spaced apart from the distal end of the first set of electrodes such that a transverse pathway extends between the proximal end of the second set of electrodes and the distal end of the first set of electrodes, said transverse pathway extending from a first axial end to a second axial end along a second central axis substantially orthogonal to the first central axis and intersecting with the first pathway at an intersection region, wherein said transverse pathway defines said interaction region, wherein receiving precursor cations in the ion processing device further comprises trapping said precursor cations within said second portion of the first pathway, and wherein introducing electrons into the interaction region of said ion processing device comprises transmitting said electrons along said transverse pathway toward said intersection region.

13. The method of claim 12, wherein product ions are mass-selectively removed from the interaction region upon formation.

14. The method of claim 13, wherein product ions exhibiting an m/z greater than a threshold m/z are removed from the interaction region upon formation, wherein the threshold m/z is greater than the m/z of the product ions.

15. The method of claim 12, further comprising applying an auxiliary AC signal to the second set of electrodes so as to selectively drive precursor cations trapped within the second portion of the first pathway into the interaction region as electrons are being introduced therein, wherein the product ions are trapped in the second portion of the first pathway upon formation of the product ions.

16. The method of claim 12, further comprising trapping said reagent anions in said first portion of the first pathway while interacting said precursor cations with the electrons in the interaction region of the ion processing device.

17. The method of claim 12, further comprising:

transmitting through a distal outlet end of the ion processing device into a downstream quadrupole rod set the product ions removed from the interaction region upon formation; and trapping said product ions in the downstream quadrupole rod set as precursor ions within the interaction region interact with the electrons and prior to interacting the product ions with reagent ions to concentrate the product ions at the lower charge state, wherein the reagent ions are transmitted through the ion processing device and into the downstream quadrupole rod set while said product ions are trapped therein so as to reduce the charge of the product ions to concentrate the product ions at the lower charge state.

18. The method of claim 12, further comprising:

transmitting through a distal outlet end of the ion processing device into a downstream quadrupole rod set the product ions removed from the interaction region upon formation;

trapping said product ions in the downstream quadrupole rod set as precursor ions within the interaction region interact with the electrons and prior to interacting the product ions with reagent ions to concentrate the product ions at the preferred charge state;

terminating electron capture dissociation within said ion processing device; and thereafter, transmitting said product ions trapped within the downstream quadrupole rod set back into said ion processing device for interaction with said reagent ions.

19. The method of claim 12, wherein the electrons interact with the precursor ions in the absence of a dipolar AC excitation field in the interaction region.

* * * * *